United States Patent [19]

Petrizio

[11] 4,168,476

[45] Sep. 18, 1979

[54] AC VOLTAGE REGULATOR

[75] Inventor: Cesare J. Petrizio, Flanders, N.J.

[73] Assignee: RCA Corporation, New York, N.Y.

[21] Appl. No.: 814,558

[22] Filed: Jul. 11, 1977

[51] Int. Cl.[2] ..... G05F 5/00

[52] U.S. Cl. ..... 323/19; 323/24

[58] Field of Search ..... 307/252 B, 252 Q; 323/19, 24, 34

[56] References Cited

U.S. PATENT DOCUMENTS

| | | | |
|---|---|---|---|
| 3,532,855 | 10/1970 | Cleave | 323/24 X |
| 4,004,214 | 1/1977 | Evans | 323/19 |
| 4,076,974 | 2/1978 | Gee | 323/19 X |

*Primary Examiner*—A. D. Pellinen

*Attorney, Agent, or Firm*—A. L. Limberg; J. M. O'Meara

[57] ABSTRACT

The conductive period of a thyristor is controlled during each half cycle of an AC source to regulate the RMS voltage across a load at substantially a constant level as the AC source voltage fluctuates widely. A signal proportional to the voltage variation in the AC source is derived by monitoring that voltage and comparing it with a reference voltage. Conduction through the thyristor during each half cycle of the AC source is then delayed for a period of time in proportion to this signal so that the period of conductivity becomes inversely proportional thereto.

6 Claims, 2 Drawing Figures

AC VOLTAGE REGULATOR

Figure 1:
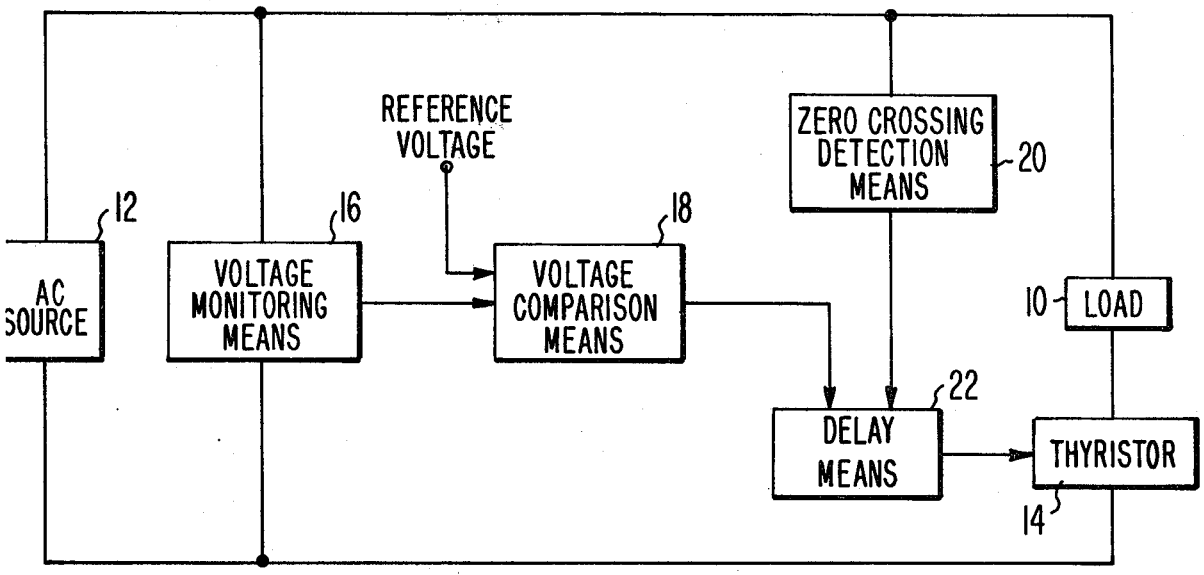

The present invention relates to circuitry for controlling the conductivity of a thyristor in regulating the AC voltage that is impressed across a load. Such circuitry may be used in many power applications, such as where the intensity of a lamp or the speed of a motor or the power dissipated in a heating unit must be precisely regulated. Frequently such applications require that the regulation be achieved as the source voltage varies widely and some applications require that the regulated voltage be adjustable.

In the prior art, many circuits have been proposed wherein thyristors are controlled to effect voltage regulation. U.S. Pat. Nos. 3,532,855 and 3,746,970 disclose examples of such circuits which generally include feedback that relates to the load voltage and control the conductivity period of the thyristor in inverse proportion to the feedback. However, precise voltage regulation can only be maintained with such circuits if source voltage variation is limited to a narrow range.

In the present invention, the AC source voltage is monitored and compared with a reference voltage to derive a DC voltage in proportion to the differential therebetween. Each zero crossing of the AC source voltage is detected and subsequent thereto a thyristor is rendered conductive with the delay time therebetween being proportional to that DC voltage. Adjustability of the regulated voltage level is accomplished in one specific embodiment of the invention by incorporating a potentiometer in the source voltage monitoring means to vary the constant of proportionality between the source voltage and the reference voltage. Excessive current drain is avoided in another specific embodiment by triggering the thyristor through a logic gate with the input thereof coupled through a capacitor and biased through a resistor to provide only temporary changes in output therefrom.

Figure 2:
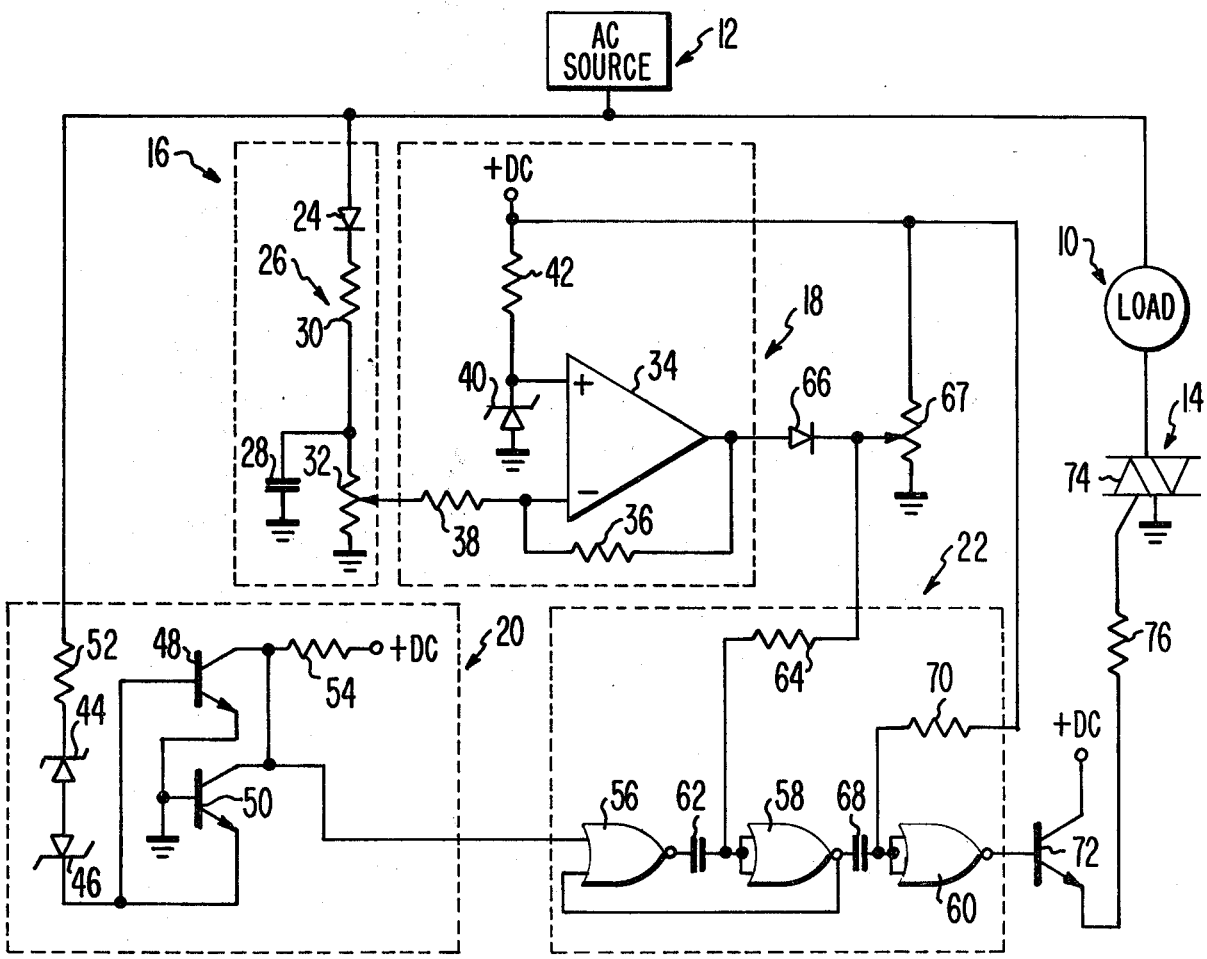

In the drawings:

FIG. 1 is a block diagram for the voltage regulating apparatus of this invention; and FIG. 2 is a schematic diagram wherein the block elements of FIG. 1 are further defined along with the elements of other more particular embodiments.

Turning now to the drawings, the voltage regulating apparatus of this invention is incorporated within the block diagram of FIG. 1 where a load 10 is conventionally connected across an AC source 12 through a thyristor 14. A means 16 for monitoring the voltage of the AC source 12 is connected thereacross and output from this voltage monitoring means 16 is connected to a means 18 for comparing the source voltage with a reference voltage to derive a DC voltage level in proportion to the differential therebetween. Signal outputs from a means 20 for detecting each zero crossing of the voltage from the AC source 12 and those from the comparison means 18 are separately connected as inputs to a means 22 for rendering the thyristor 14 conductive subsequent to each zero crossing of the AC source 12 with the delay time therebetween being proportional to the DC voltage level from the comparison means 18.

The apparatus of this invention controls the conductivity of the thyristor 14 during each half cycle of the AC source 12 to regulate the RMS voltage across the load 10 at substantially a constant level while the voltage of the AC source 12 may vary over a wide range. Considering each half cycle as being 180° of the 360° in each full cycle, the conductivity of the thyristor 14 will be discussed in terms of angle which to the artisan relates directly to time. Of course, the DC voltage level of the comparison means 18 is directly related to the voltage correction at the AC source 12 that would equalize the output from the voltage monitoring means 16 to the reference voltage and therefore, the reference voltage can be set to relate that DC voltage level to the voltage of the AC source 12. Then, by rendering the thyristor 14 conductive during each half cycle after the delay means 22 has received a zero crossing indication from the detection means 20, at an angle of proportional magnitude to that DC voltage level, the RMS voltage across the load 10 is regulated to a substantially constant level. This is so because during each half cycle, the conductive angle of the thyristor 14 is then inversely proportional to the DC voltage output of the comparison means 18 but is directly proportional to the RMS voltage being impressed across the load 10. Consequently, the conductive angle of the thyristor 14 increases as the voltage of the AC source 12 decreases and decreases as that voltage increases, so that the RMS voltage across the load 10 is maintained at a substantially constant level.

Although many circuit embodiments are possible for each block element in FIG. 1, particularly appropriate circuits for these block elements are illustrated in FIG. 2. The voltage monitoring means 16 includes a diode 24 which is connected from one side of the AC source 12 to ground through a voltage divider 26 having the divided voltage level thereof connected to ground through a capacitor 28. Within the voltage divider 26 a fixed resistor 30 and a potentiometer 32 are series connected with the output of the voltage monitoring means 16 being taken from the potentiometer 32. Each positive half cycle from the AC source 12 passes through the diode 24 and charges the capacitor 28 to a voltage level in accordance with the time constant that results from the value of resistor 30. Although diode 24 blocks each negative half cycle from the AC source 12, the capacitor 28 is then discharged to a lower voltage level in accordance with the time constant that results from the resistance across potentiometer 32. Therefore, over any full cycle of the AC source 12, the voltage swing on capacitor 28 and the output of the voltage monitoring means 16 at the tap of the potentiometer 32 will be proportional to the peak cycle voltage of the AC source 12. Consequently, the time constants for the positive and negative half cycles can be fixed to provide a voltage swing on capacitor 28 that is compatible to the desired load voltage regulation for the encountered variation in the AC source 12, with the more precise load voltage regulation being accomplished as the voltage swing of capacitor 28 is narrowed. Of course, two fixed resistors could be arranged as the voltage divider 26 with the output of the voltage monitoring means 16 then being taken from the divided voltage level. However, the potentiometer 32 provides means for adjusting the proportionality between the peak cycle voltage of the AC source 12 and the DC voltage level from the monitoring means 16, after the positive and negative half cycle time constants have been fixed.

An operational amplifier 34 is arranged as the voltage comparison means 18, with its noninverting input connected to the reference voltage while its inverting input is connected to its output through a feedback resistor 36 and to the output of the voltage monitoring means 16 through a resistor 38. The reference voltage is derived by connecting the noninverting input to ground through a Zener diode 40 and to a bias voltage through a resistor 42. Those skilled in the electrical arts will readily understand that operational amplifier 34 is arranged to function in a differential mode in that the output therefrom is proportional to the algebraic difference between the voltage levels on the inverting and noninverting inputs thereof, with that proportionality being a well-known function relating the values of resistors 36 and 38. Of course, the output of operational amplifier 34 is the DC voltage level from comparison means 18 and as explained previously, is directly related to the voltage correction at the AC source 12 that would equalize the output from the voltage monitoring means 16 to the reference voltage. Those skilled in the electrical arts should recognize without any further explanation that resistors 36 and 38 could be variable to thereby provide adjustment in the functional characteristics of the voltage comparison means 18 within the scope of this invention.

A pair of Zener diodes 44 and 46, and a pair of transistors 48 and 50 are included in the zero crossing detection means 20. The Zener diodes 44 and 46 are series connected in a reverse polarity arrangement with one side thereof being connected to one side of the AC source 12 through a resistor 52. Transistor 48 is connected in a common-emitter arrangement with its collector to the bias voltage through a resistor 54, its base to the other side of the Zener diode arrangement, and its emitter to ground. Transistor 50 is connected in a common-base arrangement with its collector to the bias voltage through resistor 54, its emitter to the other side of the Zener diode arrangement, and its base to ground. Therefore, the collectors of transistors 48 and 50 are interconnected and a positive pulse is produced thereat for each zero crossing of the source voltage with these pulses constituting the output of the detection means 20. This is so because each positive or negative cycle from the AC source 12 only passes through the Zener diode arrangement when the Zener level is reached for the appropriate diode 44 and 46 respectively, to cause conductivity through either transistor 48 or 50 respectively. Therefore, both transistors 48 and 50 are nonconductive at the beginning of each half cycle and the positive pulse is passed to the delay means 22 during that period of nonconductivity.

NOR gates 56, 58 and 60 are included in the delay means 22. One input of gate 56 is connected to the output of the zero crossing detection means 20 and the output of this gate is connected to both inputs of gate 58 through a capacitor 62. Both inputs of gate 58 are also connected to the DC voltage level from the comparison means 18 through a resistor 64. For one of the alternative embodiments, a diode 66 is disposed to pass only a positive DC voltage level from the comparison means 18 while resistor 64 also connects the inputs of gate 58 to a potentiometer 67 which has the bias voltage applied thereacross. Output from gate 58 is connected to the other input of gate 56 and to both inputs of gate 60 through a capacitor 68. Both inputs of gate 60 are also connected to the bias voltage through a resistor 70 while the output from this gate is connected to control the thyristor 14 in a conventional manner wherein a transistor 72 is connected to the gate of a triac 74 through a resistor 76.

As is well-known by those skilled in the art, triac 74 becomes conductive as soon as the gate thereof receives a signal and remains conductive during any half cycle, even if the gate signal is removed. As explained previously, the delay means 22 renders the triac 74 conductive subsequent to each zero crossing that initiates each half cycle of the AC source 12, with the delay time before such conductivity being proportional to the DC voltage level from the comparison means 18. This is so because each pulse from the zero crossing detection means 20 causes the output from gate 56 to temporarily lower the input of gate 58 which thereby changes to a high level output and holds gate 56 at a low level output even after the pulse from detector means 20 has terminated. Capacitor 62 will then be charged through resistor 64 by whatever DC voltage exists at the output of the comparison means 18 and the output of gate 58 will return to a low level which temporarily lowers the input of gate 60. Output from gate 60 then temporarily changes to a high level which renders the triac 74 conductive through transistor 72. The input of gate 60 returns to a high level after capacitor 68 has been charged through resistor 70 by the bias voltage and the output therefrom returns to a low level to render transistor 72 nonconductive. However, the triac 74 will remain conductive until the half cycle of current from the AC source 12 is completed. Therefore, gates 56 and 58 cooperate upon receiving each zero crossing signal to keep transistor 72 nonconductive for the delay time and thereafter, transistor 72 becomes conductive through gate 60 to provide a pulse trigger for the triac 74.

Diode 66 and potentiometer 67 are only included to establish a minimum positive DC voltage level which ensures against half cycle operation. Gate 60 is only necessary in embodiments where current drain on the bias voltage supply is to be avoided and it can be eliminated along with capacitor 68 and resistor 70 where such current drain presents no problem. Transistor 72 would then be of the PNP type with its base being connected directly to the output from gate 58. Those skilled in the electrical arts will also realize without further explanation that other types of logic gates could be used to replace the NOR gates 56, 58 and 60 within the scope of this invention. Indeed, the circuit arrangement including gates 56 and 58, capacitor 62 and resistor 64 functions as a one shot device which produces a single pulse upon receiving each zero crossing signal with the duration of each pulse being in proportion to the DC voltage level from the comparison means 18, and this arrangement may be replaced by any functional equivalent.

Although this invention has been disclosed herein by describing only a few embodiments thereof, it should be understood by those skilled in the art that numerous changes in the details of construction and the combination or arrangement of parts could be made in the described embodiments without departure from the true scope and spirit of the invention. Therefore, the present disclosure should be construed as illustrative rather than limiting.

What I claim is:

1. In a circuit of the type wherein the voltage impressed across a load from an AC source is regulated through a thyristor, the improvement comprising:

means for monitoring the source voltage;

means for comparing the source voltage with a reference voltage to derive a DC voltage in proportion to the differential therebetween;

means for detecting each zero crossing of the source voltage;

delay means for rendering the thyristor conductive subsequent to each zero crossing of the source voltage with the delay time being proportional to said DC voltage; and a pair of Zener diodes and a pair of transistors included within said zero crossing detection means, said Zener diodes being series connected in a reverse polarity arrangement with one side thereof connecting to one side of the source, one of said transistors being connected in a common-emitter arrangement with its collector to a bias voltage through a resistor, its base to the other side of the Zener diode arrangement and its emitter to ground, the other of said transistors being connected in a common-base arrangement with its collector to sais bias voltage through said resistor, its emitter to the other side of the Zener diode arrangement and its base to ground, the collectors of said transistors being commonly connected to the input of said delay means and producing an output pulse for each zero crossing of the source voltage, whereby a substantially constant RMS voltage is impressed across the load regardless of wide variations in the source voltage.

2. In a circuit of the type wherein the voltage impressed across a load from an AC source is regulated through a thyristor, the improvement comprising:

means for monitoring the source voltage;

means for comparing the source voltage with a reference voltage to derive a DC voltage in proportion to the differential therebetween;

means for detecting each zero crossing of the source voltage; and delay means for rendering the thyristor conductive subsequent to each zero crossing of the source voltage with the delay time being proportional to said DC voltage, said delay means including a first logic gate having the input thereof connected to the output of said zero crossing detection means and a second logic gate having the input thereof connected to said DC voltage through a resistor and to the output of said first logic gate through a capacitor while the output thereof is connected to control the thyristor and to the input of said first logic gate, whereby the output levels of said first and second logic gates encounter a temporary change at each zero crossing of the source voltage with the temporary change period being the time required for said DC voltage to charge said capacitor through said resistor.

3. The circuit of claim 2 wherein the thyristor is controlled through a third logic gate having the input thereof connected to said reference voltage through a second resistor and to the output of said second logic gate through a second capacitor, whereby the output level of said third logic gate encounters a temporary change immediately subsequent to the temporary change period of said first and second logic gates with the temporary change period of said third logic gate being the time required for said reference voltage to charge said second capacitor through said second resistor.

4. In a circuit of the type wherein the voltage impressed across a load from an AC source is regulated through a thyristor, the improvement comprising:

means for monitoring the source voltage including a diode connected from one side of the source to ground through a voltage divider with the divided voltage level thereof being connected to ground through a first capacitor and being proportional to the source voltage;

means for comparing the source voltage with a reference voltage to derive a DC voltage in proportion to the differential therebetween, which means includes an operational amplifier having the noninverting input thereof connected to said reference voltage while the inverting input thereof is connected to the output thereof through a first resistor and to the output of said voltage monitoring means through a second resistor, said DC voltage being the output of said operational amplifier and being proportional to the differential between the source voltage and said reference voltage in accordance with the value of said first and second resistors;

means for detecting each zero crossing of the source voltage;

delay means for rendering the thyristor conductive subsequent to each zero crossing of the source voltage with the delay time being proportional to said DC voltage; and a pair of Zener diodes and a pair of transistors included within said zero crossing detection means, said Zener diodes being series connected in a reverse polarity arrangement with one side thereof connecting to one side of the source, one of said transistors being connected in a common emitter arrangement with its collector to a bias voltage through a third resistor, its base to the other side of the Zener diode arrangement and its emitter to ground, the other of said transistors being connected in a common-base arrangement with its collector to said bias voltage through said third resistor, its emitter to the other side of the Zener diode arrangement and its base to ground, the collectors of said transistors being commonly connected to the input of said delay means and producing an output for each zero crossing of the source voltage;

first and second NOR gates being included within said delay means, said first NOR gate having one input thereof connected to the output of said zero crossing detection means, said second NOR gate having both inputs thereof commonly connected to said DC voltage through a fourth resistor and to the output of said first NOR gate through a second capacitor while the output thereof is connected to control the thyristor and to the input of said first NOR gate, whereby the output levels of said first and second NOR gates encounter a temporary change at each zero crossing of the source voltage with the temporary change period being the time required for said DC voltage to charge said second capacitor through said fourth transistor.

5. The circuit of claim 4 wherein the thyristor is controlled through a third NOR gate having the input thereof connected to said reference voltage through a fifth resistor and to the output of said second NOR gate through a third capacitor, whereby the output level of said third NOR gate encounters a temporary change immediately subsequent to the temporary change period of said first and second NOR gates with the temporary change period of said third NOR gate being the time required for said reference voltage to charge said third capacitor through said fifth resistor.

6. The circuit of claim 4 wherein said voltage divider includes a potentiometer, said DC voltage and the conductivity delay time of the thyristor being adjustable with said potentiometer.

* * * * *